United States Patent [19]

Ellis et al.

[11] Patent Number: 4,599,846

[45] Date of Patent: Jul. 15, 1986

[54] CAPPING HEAD

[75] Inventors: Darwin L. Ellis; Frank M. Kelly, both of Richmond, Ind.

[73] Assignee: Aluminum Company of America, Pittsburgh, Pa.

[21] Appl. No.: 602,237

[22] Filed: Apr. 19, 1984

[51] Int. Cl.[4] ..... B65B 3/20

[52] U.S. Cl. ..... 53/331.5

[58] Field of Search ..... 53/331.5; 192/84 B, 192/84 C, 84 PM, 110 R

[56] References Cited

U.S. PATENT DOCUMENTS

| | | | |
|---|---|---|---|
| 3,771,283 | 11/1973 | Over et al. | 53/201 |
| 4,254,603 | 3/1981 | Obrist | 53/490 |
| 4,364,218 | 12/1982 | Obrist | 53/331.5 |
| 4,485,609 | 12/1984 | Kowal | 53/331.5 |
| 4,492,068 | 1/1985 | Obrist | 53/331.5 |

FOREIGN PATENT DOCUMENTS

| | | |
|---|---|---|
| 1430250 | 3/1976 | United Kingdom . |
| 2111964 | 7/1983 | United Kingdom . |

OTHER PUBLICATIONS

Alcoa Deutschland Drawing No. VK-0148 and accompanying descriptive matter.

*Primary Examiner*—Francis S. Husar
*Assistant Examiner*—Jorji M. Griffin
*Attorney, Agent, or Firm*—Max L. Williamson; J. Stewart Brams

[57] ABSTRACT

A capping head for the rotary application of a cap on a container wherein a housing adapted to be secured to a rotary spindle rotatably carries a chuck of minimal inertial mass in coaxial alignment with the spindle and an improved nonfrictional magnetic clutch transmits torque from the rotating housing to the chuck to drive the chuck in rotation and thereby carry out a capping operation.

7 Claims, 3 Drawing Figures

CAPPING HEAD

BACKGROUND OF THE INVENTION

This invention relates to capping machines, and more particularly, to a capping head for use in such a machine in the application of pre-threaded caps.

Capping machines for the application of pre-threaded caps to containers have been known for many years. They often have included a chuck which is adapted to rotationally grip a threaded cap to apply a torque thereto for securing the threaded cap on the cooperably-threaded opening of a container, such as a bottle with a threaded finish. The chuck typically is coaxially supported with respect to a rotary spindle by a rotary bearing. Rotary driving torque to drive the chuck may be provided through a magnetic clutch. The chuck thus will rotate the cap into threaded engagement on the container only until further incremental engagement would require greater torque than the magnetic clutch can deliver. At this point, the magnetic clutch begins to slip as the rotary spindle rotates with respect to the chuck. It has been one objective of such arrangement to provide uniform torque for uniform cap application throughout the range of capping operation variables, including capping machine operating speed.

Among the patents on capping machines generally, and specifically turret-type machines, is U.S. Pat. No. 3,771,283. Another patent, British Pat. No. 2,111,964, discloses a capping machine having a limited torque applicator apparatus for applying screw caps to the threaded necks of containers. The requisite torque is transmitted to a cap applicator head from a rotating power shaft by the magnetic attraction between a ring of magnets and a concentrically adjacent ring of magnetizable material.

Practitioners of the art have constantly sought ways to provide more uniform torque for screw cap application than has heretofore been applicable in known magnetic slip clutch arrangements. For example, in many rotary screw capping heads, the inertial mass of the chuck components is of such considerable magnitude as to adversely affect torque transmission to the rotary chuck. This problem has been most common in the higher ranges of capping machine operating speed and has resulted in significant variation of torque as a function of machine operating speed. To overcome this and other causes of nonuniform torque, some capping machines have been provided with sets of different capping heads for different operating speed ranges. While this approach has been helpful, it also has been uneconomical and has unduly complicated variation of capping machine operating speed. This has been especially true of the turret-type machines which have a plurality of identical capping heads that operate in continuous, repeating sequence.

Prior attempts to reduce chuck assembly inertia have included attachment of the clutch magnets by means of adhesive bonding. Another mode of maintaining uniform cap application torque, or more generally, of selectively varying the torque, has been to provide for the selective variation of spacing between the driving and driven elements of the magnetic clutch by the insertion or removal of spacers in the magnetic clutch assembly, or by adjustment of a continuously variable magnet spacing adjustment mechanism. The above-cited British Pat. No. 2,111,964 discloses one such continuously variable spacing adjustment.

SUMMARY OF THE INVENTION

The present invention preferably provides for a screw capping head having a novel magnetic clutch structure for torque transmission and novel variable spacing apparatus for selective torque variations. The invention also contemplates a capping head structure with a rotary chuck of minimal inertial mass whereby a given torque value may be more readily maintained throughout the operating speed range of the capping machine.

More specifically, the invention contemplates in one presently preferred embodiment a capping head having a rotary housing which carries in rotary bearings a chuck assembly, the chuck assembly being of minimal inertial mass given the dimensional limitations imposed by the size and geometry of the cap to be applied. A magnetic clutch for transmission of rotary torque from the housing to the chuck includes two rings of permanent magnets, each arranged on an annular flux plate. A magnet retaining ring of nonmagnetic material is affixed to each flux plate to enclose the permanent magnets arranged thereon. One of the assembled magnet rings is affixed with respect to the housing at a preselected axial spacing from the companion magnet ring by one or more spacers inserted between the one magnet ring and the housing mounting surface to provide a spacing of predetermined magnitude.

It is, therefore, one general object of this invention to provide a novel and improved screw capping head which is able to provide uniform cap application torque throughout a wide range of machine operating speeds substantially without magnetic clutch adjustment.

Another object of the invention is to provide a novel and improved magnetic torque transmission clutch for a screw capping head.

Still another object of the invention is to provide a screw capping head having minimal inertial mass in those components whose inertia tends to increase the torque applied during screw cap application.

BRIEF DESCRIPTION OF THE DRAWINGS

These and other objects of the invention will be more fully understood upon consideration of the following description and the accompanying drawings, in which.

DESCRIPTION OF A PREFERRED EMBODIMENT

Figure 1:
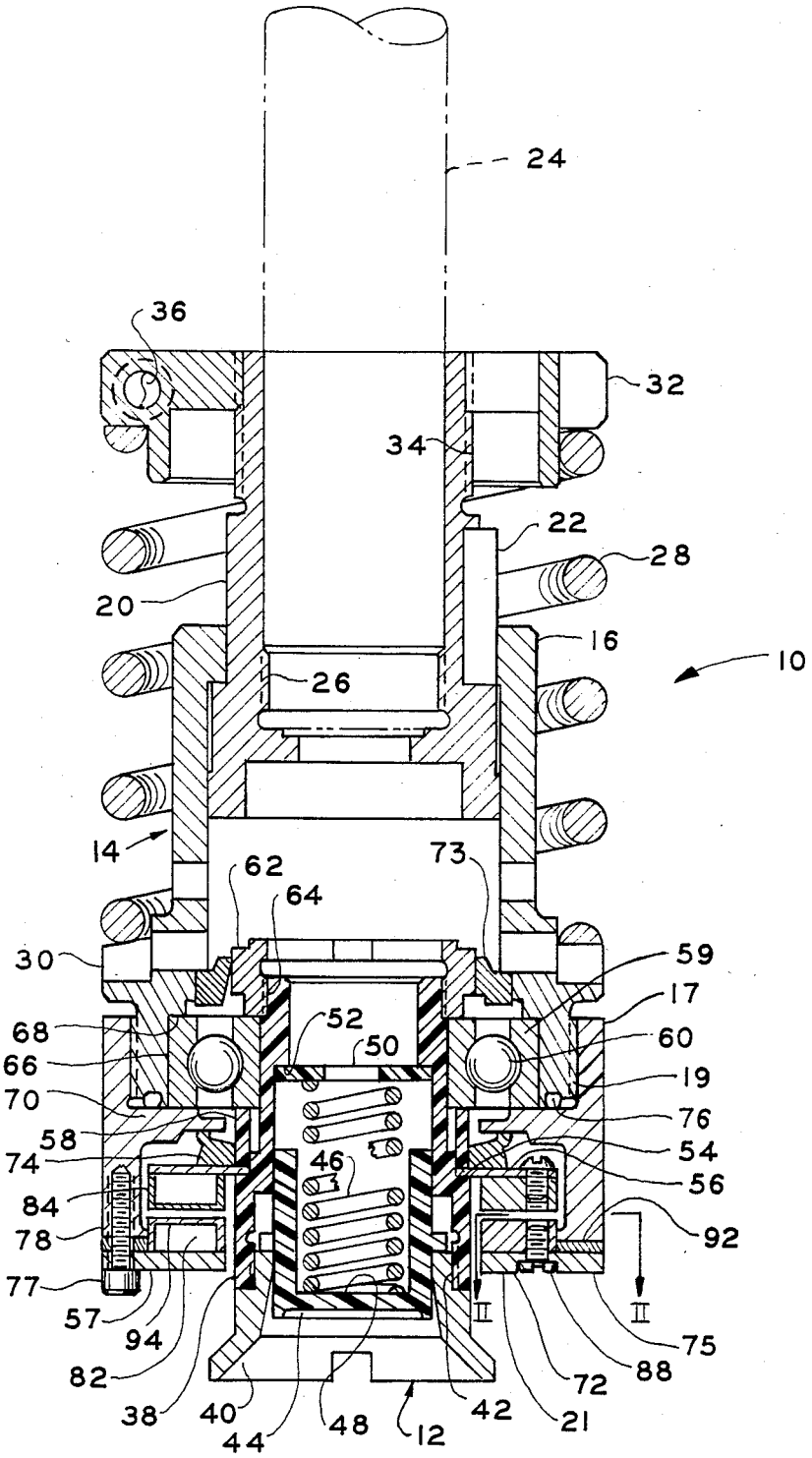
FIG. 1 is a sectioned side elevation of a screw capping head of the present invention.

There is generally indicated at 10 in FIG. 1 a capping head assembly according to one presently preferred embodiment of the invention and including a chuck assembly 12 rotatably supported coaxially within the lower end of a capping housing assembly 14 and rotatably driven thereby by a magnetic clutch assembly 21. The housing assembly 14 includes an elongated upper housing 16 which is disposed coaxially with respect to a lower housing 17 as by threads 19. Upper housing 16 is comprised of a pair of elongated, telescoping coaxial housing elements 18 and 20 which are keyed together by a captive key 22 for common axial rotation with a rotary spindle 24 on which housing element 20 is nonrotatably mounted as by internal threads 26. A top load compression spring 28 encompasses upper housing 16 and extents axially intermediate an annular spring seat 30 on housing element 18 and a top load adjustment ring 32 which encompasses housing element 20 and is engaged upon threads 34 adjacent the upper end of housing element 20. A clamp screw 36 is provided in adjustment ring 32 to lock the ring 32 at any desired position within its range of movement axially along threads 34. As the chuck engages the cap upon the container to be capped, a top load is provided for cap-to-container sealing and or for adequate rotary frictional engagement between the chuck and he cap, by slight telescoping of the housing elements 18, 20 to compress spring 28. Chuck assembly 12 includes an elongated, generally stepped, cylindrical body member 38 having a wear-resisting steel cap-engaging chuck 40 secured coaxially adjacent a lower end thereof as by threads 42. A cylindrical lightweight plastic knock-out plunger 44 is axially movable within an aluminum body member 38 toward and away from chuck 40 and is continuously biased toward the chuck 40 by a coil spring 46 which is compressed between an upwardly facing seat 48 in plunger 44 and a back-up lightweight plastic washer 50 which is seated upon a downwardly facing annular seat 52 formed on the inner periphery of body member 38. The biased knock-out plunger thus serves to positively disengage a cap from the chuck 40 once the capping operation is completed.

The exterior periphery of body member 38 is formed to receive and retain in longitudinally abutting relationship a series of annular elements which encompass the body 38. Specifically, an upwardly facing annular shoulder 54 is formed on the exterior periphery of body 38 to support a series of axially abutting elements including a magnet ring 56 of the magnetic clutch 21, an aluminum spacer ring 58, and the inner race 59 of a ball bearing assembly 60.

An internally threaded retention ring 62 is screwed onto threads 64 formed on the exterior periphery of body 38 and is tightened down to engage ball bearing race 59 and thereby rigidly clamp the bearing 60, spacer 58 and magnet ring 56 against shoulder 54.

To the extent possible, lightweight materials are used in the chuck assembly 12 in order to minimize its inertial mass. It may be noted that in this preferred embodiment, for example, the knock-out plunger 44, the body member 38, back-up washer 50 and spacer ring 58 are all made from lightweight plastic or aluminum materials.

The chuck assembly 12, as above described, is retained coaxially within the lower end of housing assembly 14 for rotation with respect thereto by lower housing 17. Specifically, the chuck assembly 12 is coaxially interfitted within the lower end of housing element 18 with the upper end of outer bearing race 66 in abutting relationship with a downwardly facing annular shoulder 68 formed on the inner periphery of the housing element 18. A radially, inwardly projecting flange portion 70 of lower housing 17 engages the opposite end of bearing race 66 when lower housing 17 is threaded onto housing element 18 to rigidly clamp the bearing race 66 with respect to the housing assembly 14 and thereby locate chuck assembly 12 for coaxial rotation with respect to housing assembly 14. Annular seals, such as at 73, 74 and 76, may be suitably provided to keep detritus and moisture out of ball bearing assembly 60 and lubricant in.

The magnetic clutch assembly 21 includes a pair of magnet rings 56, 57 disposed in coaxial juxtaposition as shown. The magnet ring 56 is secured with respect to chuck body member 38 as above described. The companion magnet ring 57 is rigidly secured to the lower end of lower housing 17 so as to reside closely subjacent the magnet ring 56.

Specifically, magnet ring 57 includes an annular flux plate 72 having a radially, outwardly projecting flange portion 75 by which magnet ring 57 is secured, as by screws 77, to a lower end 78 of lower housing 17. From the above description, it will be seen that magnetic attraction between magnet rings 56 and 57 will impart a torque load from the housing 14 which rotates with spindle 24 to the chuck assembly 12. This torque load permits the chuck assembly 12 to engage and tighten a cap which has previously been threadably engaged with a container to a predeterminable tightness, beyond which the mechanical resistance to further tightening overcomes the magnetic attraction. When this occurs, the clutch 21 merely slips as spindle 24 and housing 14 continue to rotate with respect to the chuck assembly 12.

Figure 2:
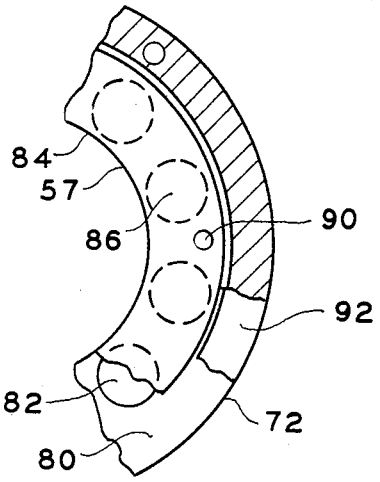
FIG. 2 is a fragmentary transverse section taken on line II—II of FIG. 1.

Referring to FIG. 2, a fragmentary portion of the lower magnet ring 57 is shown, although it will be appreciated that in all salient respects it is similar to the magnet ring 56. Accordingly, the annular flux plate 72, which is of high permeability magnetic material, includes an upwardly facing annular surface portion 80 to which a plurality of preferably cylindrical permanent magnets 82 are affixed in a ring arrangement by magnetic attraction to plate 72. A retaining ring or magnet carrier 84 of aluminum or other suitable nonmagnetic material includes a respective plurality of circumferentially spaced blind bores 86 positioned and sized to receive respective magnets 82 whereby the retaining ring 84 may be placed in coaxially abutting relation with surface 80 to enclose the magnets 82. Suitable mechanical fasteners such as screws 88 are engaged within aligned bores 90 in retaining ring 84 and plate 72 to secure these elements together and thereby secure magnets 82 in place on surface 80.

For adjustment of the axial clearance between magnet rings 56 and 57, a spacing ring or rings 92 of preselected thickness may be provided between lower housing 17 and flange portion 75 of magnet ring 57. By inserting or removing one or more rings 92, or by substituting one or more rings of different thickness, the axial clearance between magnet rings 56 and 57 may be varied and the magnetically induced torque load correspondingly varied. It is noted that the insertion or removal of spacing rings 92 requires removal of magnet ring 57 from lower housing 17 in order to vary the magnetically induced torque load. Thus, alteration of the torque adjustment of clutch 21 is deterred by the comparative difficulty of forming such alteration to prevent the operator of the capping machine from varying the torque to correct a problem in capping which may not be connected with torque.

Figure 3:
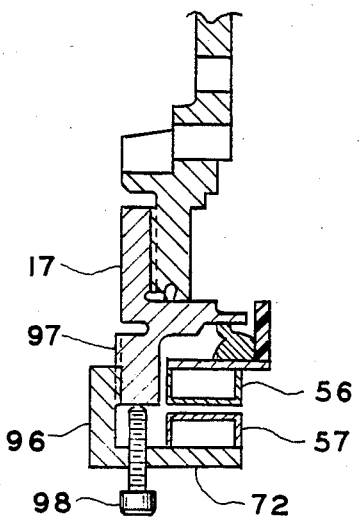
FIG. 3 is a fragmentary section of an alternate embodiment of a lower housing and flux plate of a screw capping head of this invention.

A capping head of this invention may be adapted, however, to provide greater convenience in adjusting the clearance between magnet rings 56 and 57 as may be seen with reference to FIG. 3. In this alternate embodiment, the annular flux plate 72 is provided with a threaded upwardly extending collar 96 which is adapted to threadably engage with a threaded downwardly extending leg 97 of the lower housing 17. It may be seen that the axial clearance between magnet rings 56 and 57 may be varied by rotation of the annular flux plate 72. After the desired clearance between the magnet rings is attained, set screw 98 is tightened against housing leg 97 to maintain the rings in the desired position. Thus, the torque in a capping head of this embodiment may be conveniently adjusted if such feature is desired by the user and, furthermore, the need for adding or removing spacing rings to make such adjustment is eliminated.

Referring again to FIG. 1, the external dimensions of retaining ring 84 are selected such that only a thin section cover plate portion 94 thereof covers each magnet 82. Accordingly, the respective magnets 82 in each magnet ring 56, 57 may be closely juxtaposed for maximum attractive force and torque load transmission. The smooth, unbroken outer surface of retaining rings 84 deters accumulation of dirt and otherwise affords improved ease of maintenance. Furthermore, as the magnets 82 are completely enclosed, they are retained mechanically and without resort to adhesive bonding systems of lesser integrity.

In order to minimize the inertial mass of the chuck assembly 12, the magnets 82 carried thereby are lightweight rare earth cobalt magnets or the like having a favorably low weight for the magnetic attraction afforded thereby. This, in conjunction with the use of the lightweight aluminum or equivalent for retaining ring 84, reduces the mass of the magnet ring 56 and, therefore, significantly reduces the inertial mass of the chuck assembly 12 in rotation. The judicious selection of material for the chuck assembly components also contributes to reduction of the chuck assembly inertial mass to a minimal value for the given dimensional limitations and the given torque requirements imposed by the particular capping operation under consideration.

Torque induced by the magnetic attraction varies sinusoidally in magnitude with relative rotation between the magnet rings. That is, the torque pattern includes periodic clockwise and counterclockwise effort on the driven magnet ring with respect to the driving magnet ring. The magnet rings are in a stable null position when the magnetic attraction between the rings is such that there is no relative movement between the rings. When the chuck is engaged with a cap, any external drag on the chuck from the cap tends to rotate the rings relative to each other from their stable null position, and the magnets then develop torque to overcome the resistance from the cap. As the cap becomes more tightly engaged with the container, the cap develops sufficient resistance against rotation to overcome the maximum strength of the magnets, the bearing friction and the inertial force necessary to stop the chuck assembly. The foregoing developed torque is clockwise. Further relative rotation of the rings with respect to one another caused by the stopped cap moves the rings to a position which induces an applied counterclockwise torque to the driven ring and thus to the cap. With further relative rotation of the rings with respect to one another, the counterclockwise torque is reduced until the rings are again in a stable null position, at which point clockwise torque is again applied to the cap. The foregoing torque reversals are applied to the tightened cap until the screw cap head is lifted from the cap. It may be seen that the torque developed by the magnet rings is a function of the spacing between the rings.

The inertial mass of the driven element; namely, the chuck assembly, is a significant factor in transmission of driving torque to the driven magnet ring. Specifically, the magnetic torque generated by rotatably pulling the magnet rings from their stable null position is added to by the inertial torque generated by bringing the chuck assembly to a stop by the cap resistance. The faster the capping machine speed, the greater the inertial torque becomes; thus, at higher spindle rpm's the inertial mass of the chuck assembly tends to have a greater impact on torque transmission than at lower speeds. The variation in torque over a given speed range will be greater, the larger the chuck assembly inertial mass. Thus, it is highly desirable for purposes of achieving uniform cap tightening torque to minimize the inertial mass of the chuck assembly.

It is desirable that a capping machine be adaptable for operation over a wide range of speeds because of the variety of product and capping parameters encountered in a typical capping operation.

It is an advantage that the invention according to the description hereinabove provides for a capping head that is able to apply pre-threaded caps to containers with a highly uniform torque over a wide range of capping machine operating speeds by virtue of an improved magnetic clutch and other means which limit the inertial mass of the capping head chuck assembly. For example, a capping head of this invention may be used on a capping machine adapted for operation at speeds from 10 to 400 rpm without the necessity of changing heads to accommodate various operational speeds of the machine. As the inventors hereof have contemplated various alternatives to the described preferred embodiment, it is intended that the invention be construed as broadly as permitted by the scope of the claims appended hereto.

What is claimed is:

1. A capping head for rotary application of a cap to a container comprising:

an elongated housing adapted to be secured to a rotationally driven spindle for axial rotation of said housing;

a chuck means rotatably carried by said housing for rotation with respect thereto;

said housing including a selectively removable housing portion which retains said chuck means with respect to said housing and which is removable from the capping head to permit selective release of said chuck means from said housing;

magnetic clutch means including a pair of magnetically cooperable lower and upper rings carried, respectively, by the lower axial end of said housing portion and by said chuck means for rotationally driving said chuck means in response to rotation of said housing;

said lower ring being adjustably secured to said housing portion for adjustment of the axial spacing thereof from said upper ring to thereby permit adjustment of the torque transmission capacity of said clutch means while said housing portion is maintained in its installed configuration on said caping head; and selectively interchangeable spacer means adapted to be installed axially intermediate said housing portion and said lower ring to permit said adjustment of said axial spacing by selectiv interchange of ones of said interchangeable spacer means for others of said spacers means.

2. The capping head is claimed in claim 1 wherein said clutch means is an assembly consisting of components whose inertial mass is a minimum for the dimensional limitations imposed by the given capping operation.

3. The capping head as claimed in claim 1 wherein said upper ring is an assembly consising of components whose inertial mass is a minimum for the magnetically effective torque transmission requirements imposed by the given capping operation.

4. The capping head as claimed in claim 3 wherein at least said upper ring is comprised of a plurality of cylindrical permanent magnets arranged in circumferentially spaced relationship about said chuck means on a flux plate which is retained by said chuck means in encompassing relationship therewith.

5. The capping head as claimed in claim 4 wherein said permanent magnets are enclosed within respective blind bores spaced circumferentially about an annular retaining ring which is positioned coaxially adjacent said flux plate and mechanically secured thereto.

6. The capping head as claimed in claim 5 wherein said retaining ring is an aluminum ring.

7. The capping head as claimed in claim 6 wherein said permanent magnets are rare earth cobalt magnets.

* * * * *